US009188005B2

(12) United States Patent
Kimberlin et al.

(10) Patent No.: US 9,188,005 B2
(45) Date of Patent: Nov. 17, 2015

(54) SLIDING VANE PUMP WITH INTERNAL CAM RING

(75) Inventors: Robert R. Kimberlin, Murfreesboro, TN (US); Jie Jiang, Nashville, TN (US)

(73) Assignee: Standex International Corporation, Salem, NH (US)

( * ) Notice: Subject to any disclaimer, the term of this patent is extended or adjusted under 35 U.S.C. 154(b) by 785 days.

(21) Appl. No.: 12/389,514

(22) Filed: Feb. 20, 2009

(65) Prior Publication Data

US 2009/0180913 A1 Jul. 16, 2009

Related U.S. Application Data

(63) Continuation-in-part of application No. 12/250,753, filed on Oct. 14, 2008, now Pat. No. 8,419,384.

(60) Provisional application No. 60/980,932, filed on Oct. 18, 2007.

(51) Int. Cl.

| | |
|---|---|
| ***F01C 21/08*** | (2006.01) |
| ***F04C 2/344*** | (2006.01) |
| ***F04C 14/06*** | (2006.01) |

(Continued)

(52) U.S. Cl.

CPC ..... *F01C 21/0836* (2013.01); *F04C 2/3446* (2013.01); *F04C 14/06* (2013.01); *F04C 14/26* (2013.01); *F04C 14/28* (2013.01);

(Continued)

(58) Field of Classification Search

CPC ..... F04C 2/344
USPC ..... 418/259–261, 223
See application file for complete search history.

(56) References Cited

U.S. PATENT DOCUMENTS

| | | | | |
|---|---|---|---|---|
| 2,280,272 | A * | 4/1942 | Sullivan | 417/250 |
| 3,097,610 | A | 7/1963 | Swanson | |

(Continued)

FOREIGN PATENT DOCUMENTS

| | | |
|---|---|---|
| DE | 3324878 | 1/1984 |
| DE | 2622164 A1 | 12/1997 |

(Continued)

OTHER PUBLICATIONS

Machine Translation of DE 2622164A1 obtained from European Patent Office database.

*Primary Examiner* — Nathan J Newhouse
*Assistant Examiner* — Christopher Bobish
(74) *Attorney, Agent, or Firm* — Luedeka Neely Group, P.C.

(57) ABSTRACT

The present disclosure provides a fluid pump having a pump motor, a pump drive shaft and a vane pump assembly. The pump assembly includes a pump housing having fluid inlet and outlet ports. The pump assembly also includes a distal bearing member having first and second sides and a second side, a plurality of inlet orifices, and a cavity formed in the second side. A first cam ring, having an elliptical interior opening, is disposed within the pump housing adjacent the distal bearing member. A rotor is disposed within the opening in the first cam ring. This rotor has first and second sides, a cavity in the first side, and a plurality of radial slots for sliding vanes. The vane pump assembly also includes a second cam ring, having an elliptical shape, disposed in the cavities formed in the distal bearing member second side and the rotor first side. In addition, the vane pump assembly includes a proximate bearing member disposed within the pump housing adjacent the first cam ring and having a plurality of outlet orifices.

23 Claims, 4 Drawing Sheets

(51) Int. Cl.
*F04C 14/26* (2006.01)
*F04C 14/28* (2006.01)

(52) U.S. Cl.
CPC ..... *F04C 2270/21* (2013.01); *F04C 2270/701* (2013.01); *F05C 2225/00* (2013.01)

(56) References Cited

U.S. PATENT DOCUMENTS

| | | | | | |
|---|---|---|---|---|---|
| 3,890,071 | A | * | 6/1975 | O'Brien | 418/260 |
| 4,543,228 | A | | 9/1985 | Bingler | |
| 4,716,726 | A | | 1/1988 | Nowaczyk | |
| 4,728,272 | A | * | 3/1988 | Simonsen | 418/152 |
| 4,963,080 | A | * | 10/1990 | Hansen | 418/260 |
| 5,069,608 | A | * | 12/1991 | Rather | 418/261 |
| 5,100,308 | A | * | 3/1992 | Gevelhoff et al. | 418/30 |
| 5,462,413 | A | | 10/1995 | Schroeder | |
| 5,642,991 | A | | 7/1997 | Singleterry et al. | |
| 5,842,600 | A | | 12/1998 | Singleterry et al. | |
| 5,919,033 | A | | 7/1999 | Singleterry et al. | |
| 6,050,796 | A | | 4/2000 | Wong et al. | |
| 6,088,916 | A | | 7/2000 | Singleterry et al. | |
| 6,149,409 | A | | 11/2000 | Palakodati et al. | |
| 6,153,690 | A | | 11/2000 | Larson et al. | |
| 6,481,992 | B2 | | 11/2002 | Wong et al. | |
| 6,503,064 | B1 | | 1/2003 | Croke et al. | |
| 6,554,596 | B1 | * | 4/2003 | Patterson et al. | 418/260 |
| 6,629,829 | B1 | * | 10/2003 | Shinoda et al. | 418/102 |
| 6,790,019 | B1 | | 9/2004 | Hinchey, Jr. | |
| 6,799,549 | B1 | * | 10/2004 | Patterson et al. | 123/204 |
| 6,814,549 | B2 | | 11/2004 | Kimberlin et al. | |
| 6,837,688 | B2 | | 1/2005 | Kimberlin et al. | |
| 6,847,140 | B2 | | 1/2005 | Kimberlin et al. | |
| 6,861,777 | B2 | | 3/2005 | Kimberlin et al. | |
| 6,863,504 | B2 | | 3/2005 | Kimberlin et al. | |
| 6,884,043 | B2 | * | 4/2005 | Kimberlin et al. | 417/355 |
| 7,114,931 | B2 | * | 10/2006 | Wilk et al. | 418/259 |
| 2002/0122735 | A1 | | 9/2002 | Bishop et al. | |

FOREIGN PATENT DOCUMENTS

| | | | |
|---|---|---|---|
| EP | 0384335 | A1 | 2/1990 |
| EP | 1176311 | A2 | 1/2002 |
| GB | 1140213 | | 1/1969 |
| WO | WO03083311 | | 10/2003 |
| WO | 2007062116 | | 5/2007 |

* cited by examiner

SLIDING VANE PUMP WITH INTERNAL CAM RING

CROSS REFERENCE TO RELATED APPLICATIONS

This application is a continuation-in-part of copending application Ser. No. 12/250,753, filed Oct. 14, 2008. This application also claims the benefit of the filing date of provisional application No. 60/980,932, filed Oct. 18, 2007. The disclosures of the aforementioned applications are expressly incorporated by reference.

FIELD

The present disclosure relates to fluid pumps, and more particularly relates to an improved sliding vane pump.

BACKGROUND

Sliding vane pumps are known and are well suited to a variety of pumping applications due to their reliability and relatively few moving parts. However, the sliding vanes of such pumps are prone to sticking leading to decreased pump efficiency. This is particularly true at pump startup and when the internal components of the pump have been fouled by contaminants from the fluid being pumped. Accordingly, there is a need for a simple and reliable means to prevent and/or eliminate sticking or freezing of the vanes within a sliding vane pump.

SUMMARY

In a first aspect, the present disclosure provides a vane pump assembly for a fluid pump. According to one embodiment, the vane pump assembly includes a pump housing having a proximate portion and a distal portion. The proximate portion of the housing is adapted to be mounted to a pump motor. The distal portion of the housing includes a fluid inlet port and the proximate portion of the housing includes a fluid outlet port.

The vane pump assembly also includes a distal bearing member disposed within the pump housing. The distal bearing member having a first side and a second side, a cavity formed in the second side of the distal bearing member, and a plurality of inlet orifices in fluid flow communication with the fluid inlet port. A first cam ring is also disposed within the pump housing adjacent the distal bearing member. The first cam ring has an elliptical interior opening. A rotor, which is adapted to be mounted to a pump drive shaft, is disposed within the opening in the first cam ring. This rotor has a first side and a second side, a cavity in the first side of the rotor, and a plurality of radial slots in the rotor. A plurality of vanes are slidably received within the slots of the rotor. The vane pump assembly also includes a second cam ring having an elliptical shape. This second cam ring is disposed in the cavities formed in the distal bearing member second side and the rotor first side. In addition, the vane pump assembly includes a proximate bearing member disposed within the pump housing adjacent the first cam ring. The proximate bearing member has a plurality of outlet orifices in fluid flow communication with the fluid outlet port.

Rotation of the rotor causes fluids from the fluid inlet port to be drawn through the plurality of inlet orifices at an initial fluid pressure. The fluid are then directed along a plurality of fluid flow paths disposed between an inner surface of the cam ring and an outer surface of the rotor, and then ejected through the plurality of outlet orifices to the fluid outlet port at a second fluid pressure which is greater than the initial fluid pressure.

In a second aspect, the present disclosure provides a fluid pump. According to one embodiment, the fluid pump includes a pump motor, a pump drive shaft attached to the pump motor, and a vane pump assembly.

The vane pump assembly, in turn, includes a pump housing having a proximate portion and a distal portion. The proximate portion of the housing is mounted to a pump motor so that the pump drive shaft extends through the proximate portion of the pump housing. The distal portion of the housing includes a fluid inlet port and the proximate portion of the housing includes a fluid outlet port.

The vane pump assembly also includes a distal bearing member disposed within the pump housing. The distal bearing member having a first side and a second side, a cavity formed in the second side of the distal bearing member, and a plurality of inlet orifices in fluid flow communication with the fluid inlet port. A first cam ring is also disposed within the pump housing adjacent the distal bearing member. The first cam ring has an elliptical interior opening. A rotor, which is adapted to be mounted to a pump drive shaft, is disposed within the opening in the first cam ring. This rotor has a first side and a second side, a cavity in the first side of the rotor, and a plurality of radial slots in the rotor. A plurality of vanes are slidably received within the slots of the rotor. The vane pump assembly also includes a second cam ring having an elliptical shape. This second cam ring is disposed in the cavities formed in the distal bearing member second side and the rotor first side. In addition, the vane pump assembly includes a proximate bearing member disposed within the pump housing adjacent the first cam ring. The proximate bearing member has a plurality of outlet orifices in fluid flow communication with the fluid outlet port.

Rotation of the rotor causes fluids from the fluid inlet port to be drawn through the plurality of inlet orifices at an initial fluid pressure. The fluid are then directed along a plurality of fluid flow paths disposed between an inner surface of the cam ring and an outer surface of the rotor, and then ejected through the plurality of outlet orifices to the fluid outlet port at a second fluid pressure which is greater than the initial fluid pressure.

In certain embodiments according to the present disclosure, the sliding vanes preferably move in a generally elliptical path between the first and second cam rings as the rotor rotates thereby causing the sliding vanes to reciprocate back and forth within the slots of the rotor.

In certain embodiments according to the present disclosure, the vane pump assembly preferably also includes a relief valve assembly for providing fluid flow from the outlet port to the inlet port when the pressure difference between the outlet port and the inlet port exceeds a predetermined amount. This relief valve assembly includes a passage for selectively providing flow communication between the outlet port and the inlet port. The relief valve assembly also includes a relief valve member positioned at least partially within the passage and movable between a closed position preventing flow communication between the outlet port and the inlet port and an open position allowing flow communication between the outlet port and the inlet port. A spring is also included for biasing the relief valve member in the closed position until the pressure difference between the outlet port and the inlet port exceeds the predetermined amount. More preferably, the relief valve assembly also includes an adjustment screw for partially compressing the spring and thereby varying the bias on the relief valve member.

In certain other embodiments according to the present disclosure, the proximate bearing member preferably includes an opening through which the pump drive shaft may extend.

In still embodiments according to the present disclosure, the vane pump assembly preferably also includes a compressible seal for sealing the opening in the proximate bearing member. This compressible seal is biased between the proximate bearing member and the proximate end of the pump housing.

In certain embodiments according to the present disclosure, the distal bearing member preferably has two inlet orifices and the proximate bearing member preferably has two outlet orifices.

In some embodiments according to the present disclosure, the rotor preferably has at least 8 radial slots formed therein and at least 8 vanes are slidably received within the slots of the rotor In certain embodiments according to the present disclosure, radial and thrust loads exerted by fluids being directed along each of the plurality of the fluid flow paths are substantially balanced by radial and thrust loads exerted by fluids moving along the remaining fluid flow paths.

In still another, the present disclosure provides a vane pump assembly for a fluid pump. In one embodiment, the pump assembly includes a pump housing having a fluid inlet port a fluid outlet port; a first cam ring housing having an elliptical interior opening disposed within the pump housing; a rotor disposed within the opening in the first cam ring, the rotor having a plurality of radial slots and a cavity in a first side of the rotor; a plurality of vanes slidably received within the slots of the rotor; and a second cam ring having an elliptical shape and being at least partially disposed in the cavity of the rotor. The sliding vanes in the pump assembly move in a generally elliptical path between the first and second cam rings as the rotor rotates thereby causing the sliding vanes to reciprocate back and forth within the slots of the rotor.

Advantageously according to the present disclosure, the sliding vanes will generally be pushed outward by the second cam ring during low speed operation of the pump assembly. In addition, should one or more of the sliding vanes become stuck in the rotor slot due to debris or contaminant buildup, the second cam ring may also push the frozen vane free. Once steady state, high-speed operation of the pump is achieved, however, centrifugal forces and/or as fluid pressure will generally push the sliding vanes outward so that the vanes are in contact with the inner surface of the first came ring but are not in contact with the second cam ring. This results in reduced internal friction within the pump assembly as well as reduced wear on the sliding vanes.

BRIEF DESCRIPTION OF THE DRAWINGS

Further advantages of the invention are apparent by reference to the detailed description when considered in conjunction with the figures, which are not to scale so as to more clearly show the details, wherein like reference numbers indicate like elements throughout the several views, and wherein.

DETAILED DESCRIPTION

According to one embodiment of the present disclosure, a fluid pump 10 is provided. The fluid pump 10 according to the present disclosure is suitable for pumping a wide variety of liquids. The fluid pump 10 is particularly suited for pumping water for use in beverages, such as for pumping water in carbonated water systems, for espresso machines, and beer cooling systems.

Figure 1:
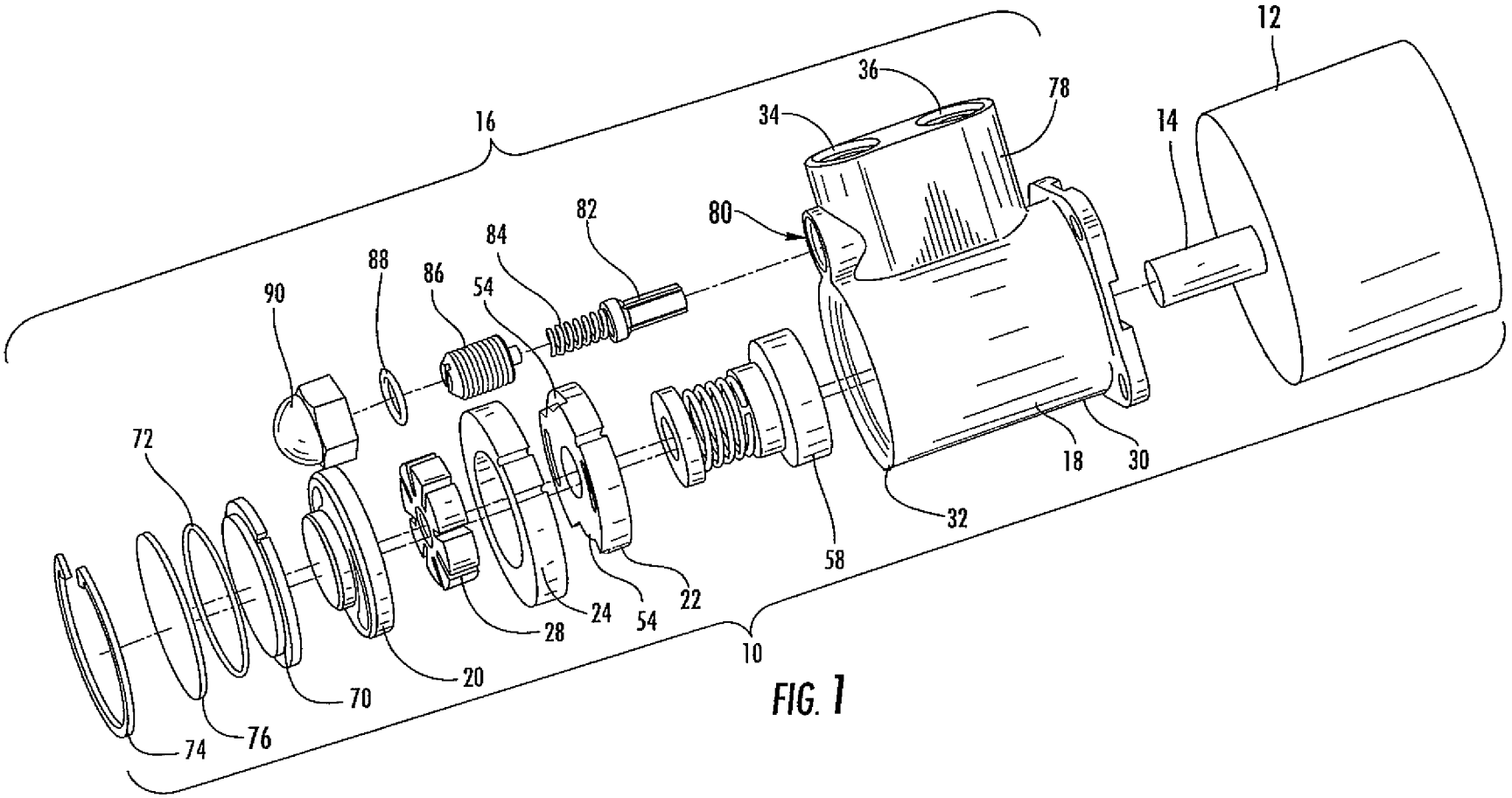
FIG. 1 is an exploded view of a vane pump according to one embodiment of the present disclosure.

As may be seen in FIG. 1, the fluid pump 10 includes a pump motor 12. The pump motor 12 is preferably an electric motor; however, the pump motor 12 may alternatively be powered by other means such as an internal combustion motor. A pump drive shaft 14 is attached to the pump motor 12 and driven thereby. The pump drive shaft 14 is preferably made from a metal such as steel.

The fluid pump 10 also includes a vane pump assembly 16 which is attached to the pump motor 12 and driven by the drive shaft 14. With further reference to FIG. 1, the vane pump assembly 16 includes at least a pump housing 18, a distal bearing member 20, a proximate bearing member 22, a first and a second cam ring 24, 26, and a rotor 28.

The pump housing 18 is preferably generally cylindrical in shape. For convenience, the end of the pump housing 18 adjacent the pump motor 12 is referred to herein as the proximate end 30, and the end of the pump housing 18 opposite the pump motor 12 is referred to herein as the distal end 32. Likewise the portion of the pump housing 18 adjacent the pump motor 12 is referred to herein as the proximate portion, and the portion of the pump housing 18 opposite the pump motor 12 is referred to herein as the distal portion.

The proximate end 30 of the pump housing 18 is adapted to be mounted on the pump motor 12, preferably by means of a flange having a plurality of bolt holes formed therein. The pump housing 18 also includes both a fluid inlet port 34 and a fluid outlet port 36. The fluid inlet port 34 is formed in the distal portion of the housing 18 and the fluid outlet port 36 is formed in a proximate portion of the housing 18.

The pump housing 18 is generally formed from a high strength material. In certain embodiments, the pump housing 18 is preferably formed a metal such as brass or stainless steel; however, in other embodiments, the pump housing 18 is preferably made from a high strength plastic material. More preferably the pump housing 18 is made from an injection molded plastic material. The plastic material may be reinforced with fibers such as glass fibers for added strength. In certain embodiments according to the present disclosure, no additional or secondary machining operations (milling, grinding, CNC, etc.) are carried out on the plastic housing 18 after it is molded to shape.

Figure 5:
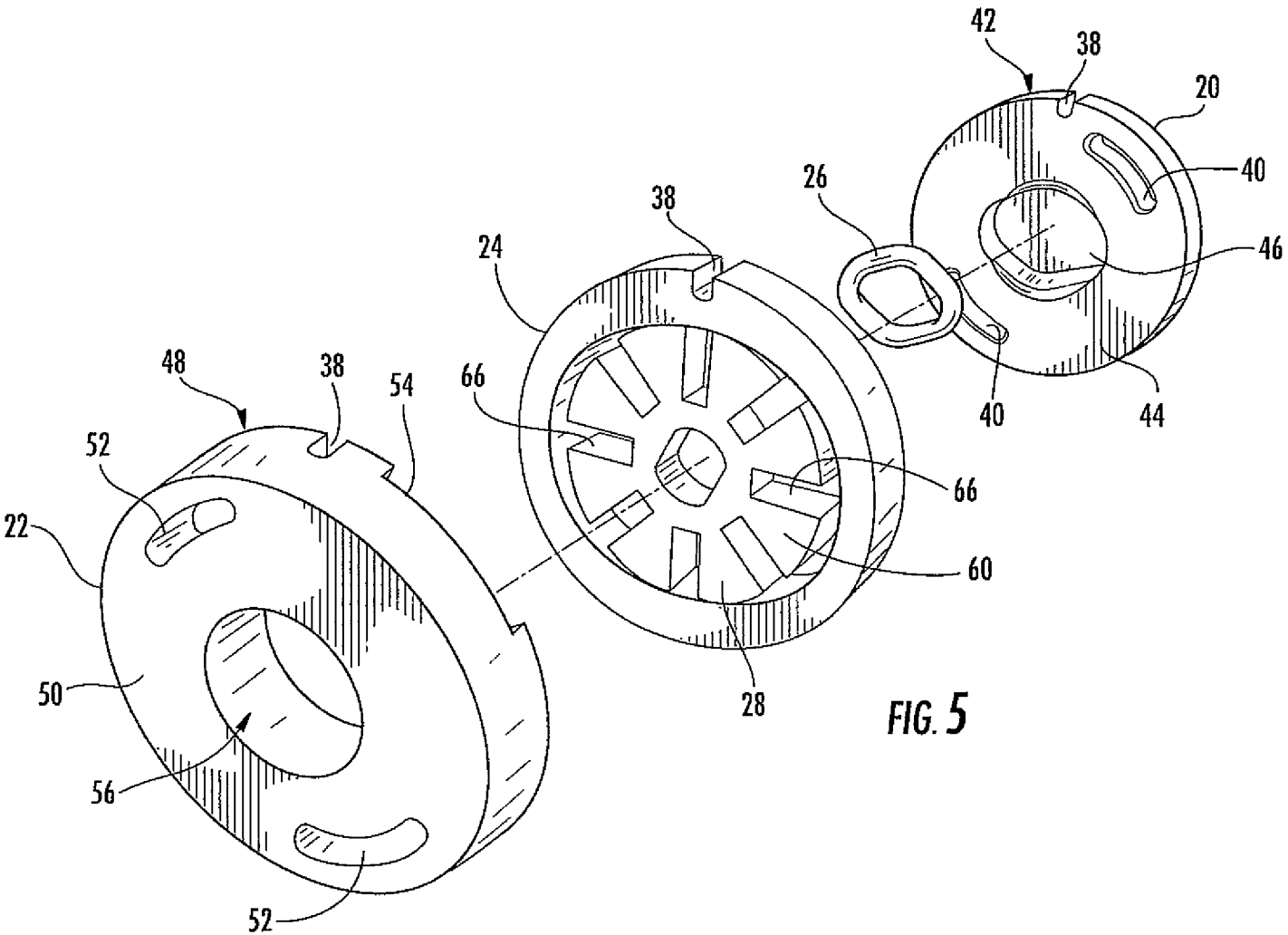
FIG. 5 is an exploded view of a portion of a vane pump assembly according to one embodiment of the present disclosure.

As shown in FIGS. 1 and 5, the first and proximate bearing members 20, 22 and the first cam ring 24 are fitted inside the pump housing 18, with the distal bearing member 20 being disposed in the distal portion of the housing 18 and adjacent the first cam ring 24, the proximate bearing member 22 being disposed in the proximate portion of the housing 18 and adjacent the first cam ring 24, and the first cam ring 24 being disposed between the bearing members 20, 22.

The bearing members 20, 22 and first cam ring 24 may be formed from a metal; however, the bearing members 20, 22 and first cam ring 24 may also be suitable formed from a rigid non-metallic material, such as plastic or a composite material. In some embodiments according to the present disclosure, the bearing members 20, 22 and the first cam ring 24 are preferably formed from a synthetic graphite composite material. A slot or groove is preferably formed on the exterior surface of the first cam ring 24 and each of the bearing members 20, 22. A key is preferably inserted into these slots or grooves 38 so as to maintain the first cam ring 24 and bearing members 20, 22 in a desired alignment relative to one another.

Figure 2:
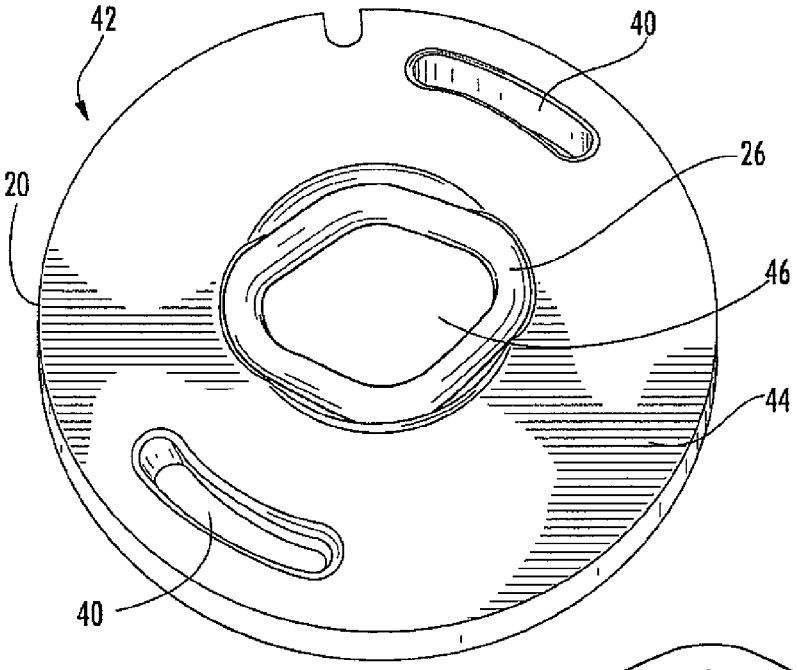
FIG. 2 is perspective view of a bearing member and a cam ring according to one embodiment of the present disclosure.

As may be seen in FIGS. 2 and 5, the distal bearing member 20 includes a plurality of inlet orifices 40, preferably two inlet orifices 40, which allow fluids to flow from the fluid inlet port 34 through the distal bearing member 20 and into the interior of the first cam ring 24 as discussed in greater detail below. Preferably, the inlet orifices 40 are shaped as curved slots formed in the distal bearing member 20.

The distal bearing member 20 has a first side 42, facing away from the pump motor 12 and a second side 44 facing in the direction of the pump motor 12. The second side 44 of the distal bearing member 20 includes a cavity 46 formed therein. As discussed in more detail below, a second cam ring 26 is partially retained within this cavity 46. The cavity 46 preferably has a generally elliptical or diamond-like shape corresponding to the shape of the second cam ring 26.

Likewise, the proximate bearing member 22 has a first side 48 and a second side 50 and includes a plurality of outlet orifices 52, preferably two outlet orifices 52, which allow fluids to flow from the interior of the first cam ring 24 through the proximate bearing member 22 and to the fluid outlet port 36. The outlet orifices 52 are also preferably shaped as curved slots. Significantly, the outlet orifices 52 are offset from the inlet orifices 40, preferably by an angle of approximately 90 degrees as measured from the centers of the respective inlet and outlet orifices 52. In addition, in certain embodiments the proximate bearing member 22 may also include a pair of channels 54 on the first side 48 of the bearing member 22. These channels 54 are offset approximately 90 degrees from the outlet orifices 52 and function as supplemental inlet orifices to allow additional fluid flow from the inlet port 34 through the vane pump assembly 16.

The proximate bearing member 22 also preferably includes an opening 56 to allow the pump drive shaft 14 to pass through the proximate bearing member 22 into the interior of the first cam ring 24. A compressible seal 58 is preferably also provided for sealing this opening 56 in the proximate bearing member 22. The compressible seal 58 is disposed between, and biased by, the proximate bearing member 22 and the proximate end 30 of the pump housing 18.

Figure 3:
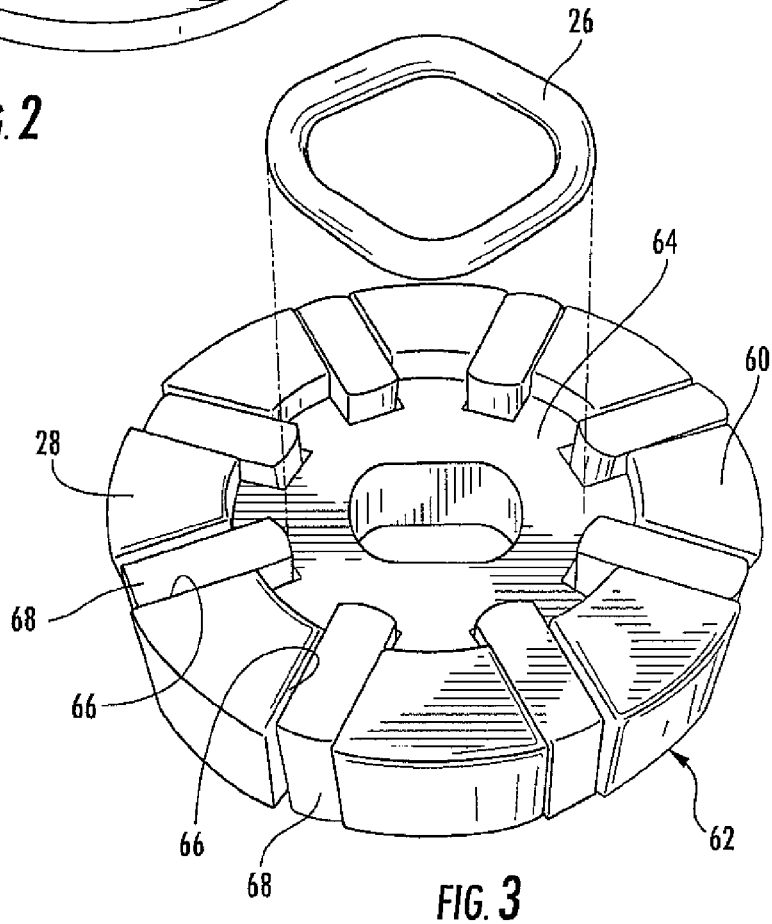
FIG. 3 is a rotor with sliding vanes and a cam ring according to one embodiment of the present disclosure.

As illustrated in greater detail in FIGS. 3 and 5, a rotor 28 is disposed within the interior of the first cam ring 24. The rotor 28 is attached to the end of the pump drive shaft 14 and driven thereby. The rotor 28 is generally formed from a high strength material, preferably a metal such as brass or stainless steel. The rotor 28 has a first side 60, facing away from the pump motor 12 and a second side 62 facing in the direction of the pump motor 12. The first side 60 of the rotor 28 includes a generally circular cavity 64 formed therein. This cavity 64 is located adjacent to the cavity 46 in the distal bearing member 20 described above and a second cam ring 26 is retained within the combined spaces of these two cavities 46, 64.

A second cam ring 26 is disposed in the space defined by these two cavities 46, 64. The second cam ring 26 is preferably made from a polymeric material (more preferably a heat resistant polymeric material) and has a generally elliptical or diamond-like shape. A portion of the second cam ring 26 fits within the cavity 46 of the distal bearing member 20 and a portion of the second cam ring 26 fits within the cavity 64 of the rotor 28. Because the cavity 46 of the bearing member 20 closely conforms to the shape of the second cam ring 26, movement of the cam ring 26 is restricted and the second cam ring 26 remains substantially stationary. However, the larger, circular cavity 64 in the rotor 28 allows the rotor 28 to rotate around the second cam ring 26.

A plurality of radially oriented slots 66 are formed in the rotor 28 and a plurality of vanes 68 are slidably received within the rotor slots 66. The rotor 28 includes at least eight slots 66 with at least eight vanes 68 slidably received therein. Preferably the rotor 28 includes eight slots 66 with eight vanes 68 slidably received therein. In certain embodiments according to the present disclosure, the vanes 68 are preferably formed from a synthetic graphite composite material.

Since the vanes 68 are slidably received within the rotor slots 66, rather than being permanently attached thereto, the vanes 68 will tend to accelerate towards the first cam ring 24 as the rotor 28 is rotated and protrude out of the rotor slots 66.

Figure 4:
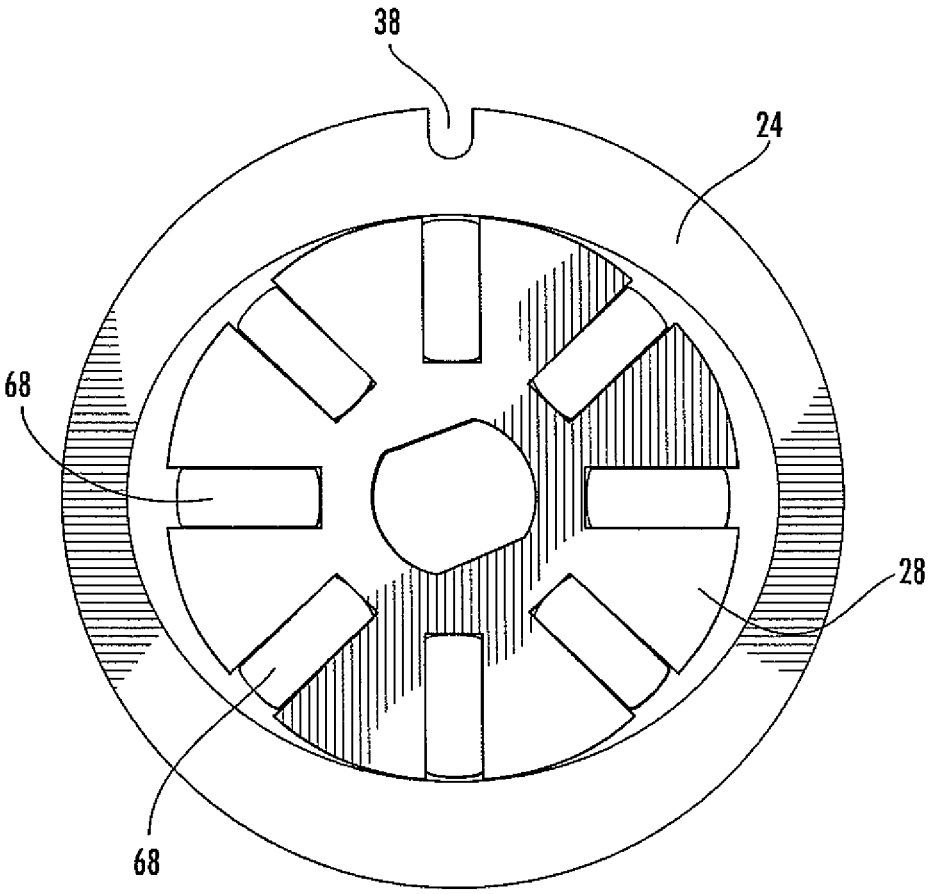
FIG. 4 is a side view of a cam ring, rotor, and sliding vanes according to one embodiment of the present disclosure.

The inner surface of the first cam ring 24 preferably has an elliptical shape somewhat similar to that of the second cam ring 26 as seen in FIG. 4. Thus, as the rotor 28 spins, the sliding vanes 68 are constrained to move in a generally elliptical path between the first and second cam rings 24, 26. As the vanes 68 move in an elliptical path while the circular rotor 28 spins, the vanes 68 reciprocate back and forth within the slots 66 of the rotor 28.

In general, the sliding vanes 68 will tend to be pushed outward by the second cam ring 26 during low speed operation, such as at startup. If one or more of the sliding vanes 68 becomes stuck in the rotor slot 66 due to debris or contaminant buildup, the second cam ring 26 may also push the frozen vane free. Once steady state, high-speed operation of the pump is achieved, centrifugal forces, as well as fluid pressure, will tend to push the vanes 68 outward so that the vanes 68 are in contact with the inner surface of the first came ring 24 but are not in contact with the second cam ring 26.

An end plate 70 is also preferably disposed within the distal portion of the housing 18 adjacent the distal bearing member 20. Unlike the pump housing 18, the end plate 70 may advantageously be formed from a relatively low strength (and hence relatively inexpensive) material such as plastic since, as discussed below, the end plate 70 is only subjected to the lower pressures of the inlet fluid and not the higher pressures of the outlet fluid. Preferably, an O-ring 72 and a retaining ring 74 are also inserted into the pump housing 18 adjacent the end plate 70. A second plate 76 may also be disposed between the end plate 70 and the retaining ring 74. In conjunction with the end plate 70, the O-ring 72 and retaining ring provide 74 a fluid seal in the distal portion of the pump housing 18.

Preferably, a relief valve assembly 78 is also included with the vane pump assembly 16. When the fluid pressure in outlet port 36 exceeds the fluid pressure in the inlet port 34 by a predetermined amount, the relief valve assembly 78 opens to allow fluid flow from the outlet port 36 to the inlet port 34, thereby reducing the outlet port 36 fluid pressure.

As may be seen in FIG. 1, this relief valve assembly 78, in one embodiment, includes a passage 80 for selectively providing flow communication between the outlet port 36 and the inlet port 34. A relief valve member 82 is positioned at least partially within this passage 80 and is movable between a closed position and an open position. In the closed position, the relief valve member 82 prevents flow communication between the outlet port 36 and the inlet port 34; however, in the open position the relief valve member 82 allows flow communication between the outlet port 36 and the inlet port 34. A spring 84 is also included which abuts against the relief valve member 82 and biases the relief valve member 82 in the closed position under normal conditions. When the pressure difference between the outlet port 36 and the inlet port 34 exceeds the predetermined amount, however, the force on the relief valve member 82 due to the pressure differential overcomes the spring force and moves the relief valve member 82 to the open position thereby allowing fluid flow through the passage 80 and relieving the excess pressure in the outlet port 36. In certain embodiments of the present disclosure, the relief valve assembly 78 also preferably includes an adjustment screw 86 for partially compressing the spring 84 and thereby varying the bias on the relief valve member 82. An O-ring 88 and an acorn nut 90 may also be fitted over the adjustment screw 86 to provide an effective fluid seal.

In operation, the pump motor 12 turns the pump drive shaft 14 thereby turning the rotor 28 as well. Rotation of the rotor 28 causes fluids from the fluid inlet port 34 to be drawn through the plurality of inlet orifices 40 at an initial fluid pressure. The fluids are then directed along a plurality of arcuate fluid flow paths between the inlet orifices 40 and the outlet orifices 52. The fluid flow paths correspond to the space between the inner surface of the first cam ring 24 and the outer surface of the rotor 28. Finally, the fluids are ejected through the plurality of outlet orifices 52 to the fluid outlet port 36 at a second fluid pressure which is greater than the initial fluid pressure.

A significant advantage is achieved by the movement of the fluid along the plurality of fluid flow paths according to the present disclosure. Movement of the fluids along each of the individual fluid flow paths places significant radial and thrust loads upon the components of the vane pump assembly 16, including the pump housing 18, the first and proximate bearing members 20, 22, the first cam ring 24, and the rotor 28. According to the present disclosure, however, the radial loads exerted by fluids moving along the individual fluid flow paths are substantially balanced, and thus cancelled out, by the radial loads exerted by fluids moving along the remaining fluid flow paths. In some instances a portion of the thrust loads may be cancelled out as well.

Advantageously, because the loads being exerted upon the components of the vane pump assembly 16 are substantially balanced in this manner, the components may be manufactured to somewhat less stringent physical tolerances than if the components were subjected to unbalanced radial and thrust loads. In particular, the pump housing 18 may be manufactured to less stringent physical tolerances. This in turn preferably allows for the pump housing 18 to be fabricated from a relatively inexpensive plastic material, more preferably a molded plastic material, rather than being machined from a more expensive metal material. Further, once molded to shape, no additional machining operations, such as milling or grinding, are needed to bring the pump housing 18 into its final tolerances. In addition, more components can be manufactured from materials such as plastics and the need for precision machining of pump components is reduced.

This is in contrast to prior art sliding vane pump designs having only a single fluid flow path within the pump. Movement of the fluids along a single fluid flow path in such pump places significant radial loads, as well as thrust loads, upon the components of the vane pump assembly 16 which are not balanced. In order to properly function in spite of these load, components in these prior art designs must typically be precisely machined from metals or other expensive materials which can be machined to very high tolerances. Molded plastic components generally cannot be used in such pump designs.

As previously noted, fluid pumps according to the present disclosure are suitable for pumping a wide variety of liquids, but are particularly suited to food and beverage service application such as for pumping water in carbonated water systems, for espresso machines, and beer cooling systems. In these applications, it is particularly advantageous to use a molded plastic pump, which is fiber reinforced for added strength, but which has not been subjected to secondary machining operations subsequent to being molded. Subsequent machining of the surfaces of the molded plastic would expose the reinforcing fiber material and lead to contact between the fibers and the water or other fluid being pumps. In a food and beverage application, contact between such fibers and the water/beverage may be undesirable or may be forbidden by applicable health and safety regulations. Advantageously, such concerns are eliminated if the plastic pump housing 18 is molded to shape without the need for further machining steps.

A further advantage is provided by the inclusion of the second cam ring 26 in the vane pump assembly 16. A problem with prior designs for sliding vane pumps has been that the vanes of such pumps are prone to sticking, particularly at pump startup and when the internal components of the pump have been fouled by contaminants from the fluid being pumped. In prior designs, one or more steel pins have typically been included in the center and slots of the rotor. As the rotor moves, these steel pins shuttle back and forth within the rotor slots thereby impacting the sliding vanes. These impacts are generally sufficient to overcome any momentary sticking of the vanes, but may also damage the sliding vanes.

The use of the second cam ring 26 according to the present disclosure eliminates the need for such sliding vane pins. Instead as the rotor 28 moves, the second cam ring 26 contacts the ends of the sliding vanes 68, pushing the vanes outward, and overcoming any sticking of the sliding vanes. The impact forces upon the vanes from this pushing action are significantly less than the forces typically generated by the steel vane pins of prior art designs. Thus wear and damage to the sliding vanes is significantly reduced according to the present design. In addition, once steady state, high-speed operation of the pump is achieved, centrifugal forces, as well as fluid pressure, will tend to push the vanes 68 outward so that the vanes 68 are not in contact with the second cam ring 26, thus further reducing wear on the vanes 68.

The foregoing description of preferred embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. A vane pump assembly for a fluid pump for pumping water and water-based fluids, said pump assembly comprising:

a pump housing having a proximate portion and a distal portion, wherein the proximate portion of the housing is adapted to be mounted to a pump motor;

a fluid inlet port in the distal portion of the housing;

a fluid outlet port in the proximate portion of the pump housing;

a distal bearing member disposed within the pump housing, the distal bearing member having a first side and a second side, a cavity formed in the second side of the distal bearing member, and a plurality of inlet orifices in fluid flow communication with the fluid inlet port;

a first cam ring disposed within the pump housing adjacent the distal bearing member, the first cam ring having an elliptical interior opening;

a metal rotor adapted to be mounted to a pump drive shaft and disposed within the opening in the first cam ring, the rotor having a first side and a second side, a cavity in the first side of the rotor, and a plurality of radial slots;

a plurality of vanes slidably received within the slots of the rotor;

a second cam ring comprising a polymeric material and having an elliptical shape and being disposed in the cavities formed in the distal bearing member second side and the rotor first side; and a proximate bearing member disposed within the pump housing adjacent the first cam ring, the proximate bearing member having a plurality of outlet orifices in fluid flow communication with the fluid outlet port;

wherein rotation of the rotor causes fluids from the fluid inlet port to be drawn through the plurality of inlet orifices at an initial fluid pressure, to be directed along a plurality of fluid flow paths disposed between an inner surface of the first cam ring and an outer surface of the rotor, and to be ejected through the plurality of outlet orifices to the fluid outlet port at a second fluid pressure which is greater than the initial fluid pressure and wherein the pump housing comprises a molded polymeric material with unmachined molded surfaces.

2. The vane pump assembly of claim 1, wherein the sliding vanes move in a generally elliptical path between the first and second cam rings as the rotor rotates thereby causing the sliding vanes to reciprocate back and forth within the slots of the rotor.

3. The vane pump assembly of claim 1, further comprising a relief valve assembly for providing fluid flow from the outlet port to the inlet port when the pressure difference between the outlet port and the inlet port exceeds a predetermined amount, the relief valve assembly including a passage for selectively providing flow communication between the outlet port and the inlet port;

a relief valve member positioned at least partially within the passage and movable between a closed position preventing flow communication between the outlet port and the inlet port and an open position allowing flow communication between the outlet port and the inlet port;

a spring for biasing the relief valve member in the closed position until the pressure difference between the outlet port and the inlet port exceeds the predetermined amount.

4. The vane pump assembly of claim 3, further comprising an adjustment screw for partially compressing the spring and thereby varying the bias on the relief valve member.

5. The vane pump assembly of claim 1, wherein the proximate bearing member includes an opening through which the pump drive shaft may extend.

6. The vane pump assembly of claim 5, further comprising a compressible seal for sealing the opening in the proximate bearing member, wherein the compressible seal is biased between the proximate bearing member and the proximate end of the pump housing.

7. The vane pump assembly of claim 1, wherein the distal bearing member has two inlet orifices and the proximate bearing member has two outlet orifices.

8. The vane pump assembly of claim 1, wherein the rotor has at least 8 radial slots formed therein and at least 8 vanes are slidably received within the slots of the rotor.

9. The vane pump assembly of claim 1, wherein radial and thrust loads exerted by fluids being directed along each of the plurality of the fluid flow paths are substantially balanced by radial and thrust loads exerted by fluids moving along the remaining fluid flow paths.

10. The vane pump assembly of claim 1, wherein the proximate bearing member further comprises a pair of channels on the first side of the proximate bearing member.

11. The vane pump assembly of claim 10, wherein the pair of channels on the first side of the proximate bearing member are offset approximately 90 degrees from the outlet orifices and function as supplemental inlet orifices to allow additional fluid flow from the inlet port through the vane pump assembly.

12. A fluid pump for pumping water and water-based fluids comprising:

a pump motor;

a pump drive shaft attached to the pump motor; and a vane pump assembly including a pump housing having a proximate portion and a distal portion, wherein the proximate portion of the housing is mounted to the pump motor so that the pump drive shaft extends through the proximate portion of the pump housing;

a fluid inlet port in the distal portion of the housing;

a fluid outlet port in the proximate portion of the pump housing;

a distal bearing member disposed within the pump housing, the distal bearing member having a first side and a second side, a cavity formed in the second side of the distal bearing member, and a plurality of inlet orifices in fluid flow communication with the fluid inlet port;

a first cam ring disposed within the pump housing adjacent the distal bearing member, the first cam ring having an elliptical interior opening;

a metal rotor mounted on the pump drive shaft and disposed within the opening in the first cam ring, the rotor having a first side and a second side, a cavity in the first side of the rotor, and a plurality of radial slots;

a plurality of vanes slidably received within the slots of the rotor;

a second cam ring comprising a polymeric material and having an elliptical shape and being disposed in the cavities formed in the distal bearing member second side and the rotor first side; and a proximate bearing member disposed within the pump housing adjacent the first cam ring, the proximate bearing member having a plurality of outlet orifices in fluid flow communication with the fluid outlet port;

wherein rotation of the rotor by the pump drive shaft causes fluids from the fluid inlet port to be drawn through the plurality of inlet orifices at an initial fluid pressure, to be directed along a plurality of fluid flow paths disposed between an inner surface of the first cam ring and an outer surface of the rotor, and to be ejected through the plurality of outlet orifices to the fluid outlet port at a second fluid pressure which is greater than the initial fluid pressure and wherein the pump housing comprises a molded polymeric material with unmachined molded surfaces.

13. The fluid pump of claim 12, wherein the sliding vanes move in a generally elliptical path between the first and second cam rings as the rotor rotates thereby causing the sliding vanes to reciprocate back and forth within the slots of the rotor.

14. The fluid pump of claim 12, wherein the vane pump assembly further includes a relief valve assembly for providing fluid flow from the outlet port to the inlet port when the pressure difference between the outlet port and the inlet port exceeds a predetermined amount, the relief valve assembly including a passage for selectively providing flow communication between the outlet port and the inlet port;

a relief valve member positioned at least partially within the passage and movable between a closed position preventing flow communication between the outlet port and the inlet port and an open position allowing flow communication between the outlet port and the inlet port;

a spring for biasing the relief valve member in the closed position until the pressure difference between the outlet port and the inlet port exceeds the predetermined amount.

15. The fluid pump of claim 14, wherein the vane pump assembly further includes an adjustment screw for partially compressing the spring and thereby varying the bias on the relief valve member.

16. The fluid pump of claim 12, wherein the pump drive shaft extends through an opening in the proximate bearing member.

17. The fluid pump of claim 16, wherein the vane pump assembly further includes a compressible seal for sealing the opening in the proximate bearing member, wherein the compressible seal is biased between the proximate bearing member and the proximate end of the pump housing.

18. The fluid pump of claim 12, wherein the distal bearing member has two inlet orifices and the proximate bearing member has two outlet orifices.

19. The fluid pump of claim 12, wherein the rotor has at least 8 radial slots formed therein and at least 8 vanes are slidably received within the slots of the rotor.

20. The fluid pump of claim 12, wherein, radial and thrust loads exerted by fluids being directed along each of the plurality of the fluid flow paths are substantially balanced by radial and thrust loads exerted by fluids moving along the remaining fluid flow paths.

21. The fluid pump of claim 12, wherein the proximate bearing member further comprises a pair of channels on the first side of the proximate bearing member.

22. The fluid pump of claim 21, wherein the pair of channels on the first side of the proximate bearing member are offset approximately 90 degrees from the outlet orifices and function as supplemental inlet orifices to allow additional fluid flow from the inlet port through the vane pump assembly.

23. A vane pump assembly for a fluid pump for pumping water and water-based fluids, said pump assembly comprising:

a pump housing having a fluid inlet port a fluid outlet port;

a distal bearing member disposed within the pump housing, the distal bearing member having a first side and a second side, a cavity formed in the second side of the distal bearing member, and a plurality of inlet orifices in fluid flow communication with the fluid inlet port;

a first cam ring housing having an elliptical interior opening disposed within the pump housing;

a metal rotor disposed within the opening in the first cam ring, the rotor having a plurality of radial slots and a cavity in a first side of the rotor;

a plurality of vanes slidably received within the slots of the rotor;

a second cam ring comprising a polymeric material and having an elliptical shape and being disposed in the cavities formed in the distal bearing member second side and the rotor first side; and a proximate bearing member disposed within the pump housing adjacent the first cam ring, the proximate bearing member having a plurality of outlet orifices in fluid flow communication with the fluid outlet port, wherein the sliding vanes move in a generally elliptical path between the first and second cam rings as the rotor rotates thereby causing the sliding vanes to reciprocate back and forth within the slots of the rotor and wherein the pump housing comprises a molded polymeric material with unmachined molded surfaces.

* * * * *